US011109176B2

(12) United States Patent
Mate et al.

(10) Patent No.: US 11,109,176 B2
(45) Date of Patent: Aug. 31, 2021

(54) PROCESSING AUDIO SIGNALS

(71) Applicant: Nokia Technologies Oy, Espoo (FI)

(72) Inventors: Sujeet Shyamsundar Mate, Tampere (FI); Lasse Laaksonen, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/648,816

(22) PCT Filed: Sep. 18, 2018

(86) PCT No.: PCT/FI2018/050676
§ 371 (c)(1),
(2) Date: Mar. 19, 2020

(87) PCT Pub. No.: WO2019/063878
PCT Pub. Date: Apr. 4, 2019

(65) Prior Publication Data

US 2020/0228912 A1 Jul. 16, 2020

(30) Foreign Application Priority Data

Sep. 29, 2017 (GB) ..... 1715818

(51) Int. Cl.
*H04S 7/00* (2006.01)
*H04R 1/40* (2006.01)
(Continued)

(52) U.S. Cl.
CPC ..... *H04S 7/303* (2013.01); *H04R 1/406* (2013.01); *H04R 3/005* (2013.01); *H04R 5/027* (2013.01);
(Continued)

(58) Field of Classification Search
CPC ..... H04S 7/303; H04S 3/008; H04S 2400/01; H04S 2400/11; H04S 2400/15; H04R 1/406; H04R 3/005; H04R 5/027
(Continued)

(56) References Cited

U.S. PATENT DOCUMENTS

2008/0247485 A1 10/2008 Suzuki et al. ..... 375/295
2011/0194700 A1* 8/2011 Hetherington ..... H04M 3/568 381/17
(Continued)

FOREIGN PATENT DOCUMENTS

EP 2 197 219 A1 6/2010
GB 25433276 A 4/2017
(Continued)

*Primary Examiner* — William A Jerez Lora
(74) *Attorney, Agent, or Firm* — Harrington & Smith

(57) ABSTRACT

A method, apparatus and computer program including obtaining a first audio signal from at least a first microphone located at a first distance from an audio source; obtaining a local audio signal from a local microphone wherein the local microphone is located closer to the audio source than the first microphone; identifying the audio source using the first audio signal and the local audio signal; using the identified audio source to determine a delay between the first audio signal and the local audio signal: and using the determined delay to determine the length of the first audio signal and the local audio signal to be made available for processing so as to enable temporal alignment of at least the first audio signal and the local audio signal.

20 Claims, 9 Drawing Sheets

(51) Int. Cl.
*H04R 3/00* (2006.01)
*H04R 5/027* (2006.01)
*H04S 3/00* (2006.01)

(52) U.S. Cl.
CPC ..... *H04S 3/008* (2013.01); *H04S 2400/01* (2013.01); *H04S 2400/11* (2013.01); *H04S 2400/15* (2013.01)

(58) Field of Classification Search
USPC ..... 381/56, 58, 122, 124, 303
See application file for complete search history.

(56) References Cited

U.S. PATENT DOCUMENTS

| | | | | |
|---|---|---|---|---|
| 2014/0334253 | A1* | 11/2014 | Lumens | G01V 1/226 367/14 |
| 2016/0182997 | A1 | 6/2016 | Wilson | |
| 2016/0321028 | A1 | 11/2016 | Doerbecker | |
| 2017/0249936 | A1* | 8/2017 | Hayashida | G10L 15/04 |
| 2019/0387313 | A1* | 12/2019 | Bharitkar | H04R 1/406 |

FOREIGN PATENT DOCUMENTS

| | | | |
|---|---|---|---|
| JP | 2009-118194 | | 5/2009 |
| WO | WO 2010/142320 | A1 | 12/2010 |

* cited by examiner

PROCESSING AUDIO SIGNALS

CROSS REFERENCE TO RELATED APPLICATION

This patent application is a U.S. National Stage application of International Patent Application Number PCT/FI2018/050676 filed Sep. 18, 2018, which is hereby incorporated by reference in its entirety, and claims priority to GB 1715818.9 filed Sep. 29, 2017.

TECHNOLOGICAL FIELD

Examples of the disclosure relate to processing audio signals. In some examples they relate to processing audio signals to enable temporal alignment of audio signals.

BACKGROUND

Sound spaces may be recorded and rendered in any applications where spatial audio is used. For example the sound spaces may be recorded for use in mediated reality content applications such as virtual reality or augmented reality applications.

In order to enable a sound space to be rendered for a user one or more microphone arrangements obtain audio signals from different locations. The audio signals must be temporally aligned before the sound space can be rendered to a user.

BRIEF SUMMARY

According to various, but not necessarily all, examples of the disclosure there may be provided a method comprising: obtaining a first audio signal from at least a first microphone located at a first distance from an audio source; obtaining a local audio signal from a local microphone wherein the local microphone is located closer to the audio source than the first microphone; identifying the audio source using the first audio signal and the local audio signal; using the identified audio source to determine a delay between the first audio signal and the local audio signal: and using the determined delay to determine the length of the first audio signal and the local audio signal to be made available for processing so as to enable temporal alignment of at least the first audio signal and the local audio signal.

The first microphone may be part of a microphone array comprising a plurality of microphones arranged to capture spatial audio. The method may comprise obtaining a plurality of audio signals from the plurality of microphones.

The first audio signal and the local audio signals may be made available for processing by being stored in a temporary memory.

Determining the delay between the audio signals may take in to account the temporal delay between the obtained audio signals and jitter in the transmission of the obtained audio signals.

The method may comprise receiving one or more other audio signals wherein the one or more other audio signals are captured by one or more other microphone arrangements located at one or more locations different to the local microphone, and determining the temporal delay between the local audio signal and the one or more other audio signals, and using the determined delay to determine the length of the one or more other audio signals to be made available for processing so as to enable temporal alignment of the local audio signal and the one or more other audio signals.

The temporal alignment of the obtained audio signals may enable an immersive audio output to be rendered to one or more users. The users may be located at different locations.

The delay between the obtained audio signals may be determined with respect to a reference point.

The method may comprise sending a signal comprising information indicative of the length of the audio signals to be made available for processing to a processing device.

According to various, but not necessarily all, examples of the disclosure there may be provided an apparatus comprising: processing circuitry; and memory circuitry including computer program code, the memory circuitry and the computer program code configured to, with the processing circuitry, enable the apparatus to: obtain a first audio signal from at least a first microphone located at a first distance from an audio source; obtain a local audio signal from a local microphone wherein the local microphone is located closer to the audio source than the first microphone; identify the audio source using the first audio signal and the local audio signal; use the identified audio source to determine a delay between the first audio signal and the local audio signal: and use the determined delay to determine the length of the first audio signal and the local audio signal to be made available for processing so as to enable temporal alignment of at least the first audio signal and the local audio signal.

The first microphone may be part of a microphone array comprising a plurality of microphones arranged to capture spatial audio. The processing circuitry and the memory circuitry may be arranged to obtain a plurality of audio signals from the plurality of microphones The first audio signal and the local audio signals may be made available for processing by being stored in a temporary memory.

Determining the delay between the audio signals may take in to account the temporal delay between the obtained audio signals and jitter in the transmission of the obtained audio signals.

The processing circuitry and the memory circuitry may be arranged to receive one or more other audio signals wherein the one or more other audio signals are captured by one or more other microphone arrangements located at one or more locations different to the local microphone, and determine the temporal delay between the local audio signal and the one or more other audio signals, and using the determined delay to determine the length of the one or more other audio signals to be made available for processing so as to enable temporal alignment of the local audio signal and the one or more other audio signals.

The temporal alignment of the obtained audio signals may enable an immersive audio output to be rendered to one or more users. The users may be located at different locations.

The delay between the obtained audio signals may be determined with respect to a reference point.

The processing circuitry and the memory circuitry may be arranged to send a signal comprising information indicative of the length of the audio signals to be made available for processing to a processing device.

According to various, but not necessarily all, examples of the disclosure there may be provided an apparatus comprising: means for obtaining a first audio signal from at least a first microphone located at a first distance from an audio source; means for obtaining a local audio signal from a local microphone wherein the local microphone is located closer to the audio source than the first microphone; means for identifying the audio source using the first audio signal and the local audio signal; means for using the identified audio source to determine a delay between the first audio signal and the local audio signal: and means for using the determined delay to determine the length of the first audio signal and the local audio signal to be made available for processing so as to enable temporal alignment of at least the first audio signal and the local audio signal.

According to various, but not necessarily all, examples of the disclosure there may be provided a computer program comprising computer program instructions that, when executed by processing circuitry, enable: obtaining a first audio signal from at least a first microphone located at a first distance from an audio source; obtaining a local audio signal from a local microphone wherein the local microphone is located closer to the audio source than the first microphone; identifying the audio source using the first audio signal and the local audio signal; using the identified audio source to determine a delay between the first audio signal and the local audio signal: and using the determined delay to determine the length of the first audio signal and the local audio signal to be made available for processing so as to enable temporal alignment of at least the first audio signal and the local audio signal.

According to various, but not necessarily all, examples of the disclosure there may be provided a computer program comprising program instructions for causing a computer to perform the any of the methods described above.

According to various, but not necessarily all, examples of the disclosure there may be provided a physical entity embodying the computer program as described above.

According to various, but not necessarily all, examples of the disclosure there may be provided an electromagnetic carrier signal carrying the computer program as described above.

BRIEF DESCRIPTION

For a better understanding of various examples that are useful for understanding the detailed description, reference will now be made by way of example only to the accompanying drawings in which.

DETAILED DESCRIPTION

The following description describes methods, apparatus and computer programs that enable temporal alignment of obtained audio signals. The obtained audio signals may be used to provide immersive audio experiences to a user 7. For example the obtained audio signals may be used to provide a mediated reality experience such as a virtual reality or augmented reality experience. The obtained audio signals may be captured by two or more microphones which are positioned at different locations. As the microphones are positioned at different locations there is a delay in audio signals obtained at the different locations. The delay may be caused by the spatial separation of the microphones and the audio sources within a sound space. When the audio signals are being processed this delay and also any jitter which arises due to the transmission of the signals may need to be taken into account.

Examples of the disclosure therefore provide methods and apparatus for processing audio signals to enable temporal alignment of audio signals. The methods and processes enable the delay caused by the spatial separation of the microphones and the delay caused by any jitter within the system to be taken into account.

Figure 1B:
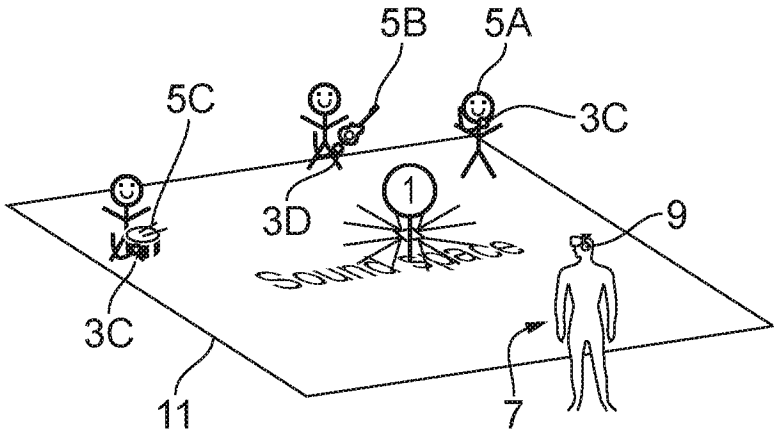
FIGS. 1A and 1B illustrate the capture of audio signals according to some examples of the disclosure.
Figure 1A:
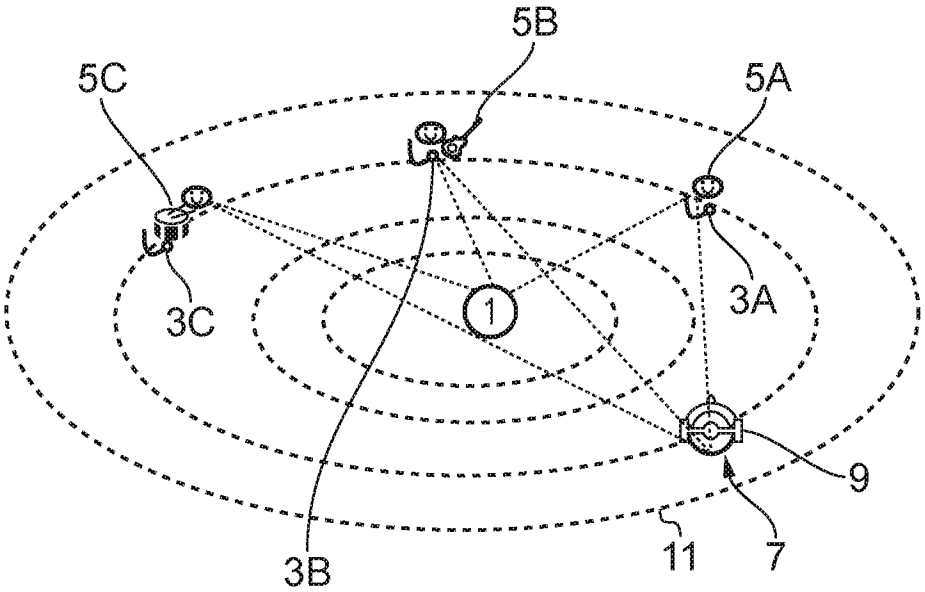

FIGS. 1A and 1B illustrate the capture of audio signals according to some examples of the disclosure. The captured audio signals may be used to provide an immersive audio experience to a user 7, or to provide any other type of spatial audio to a user 7. FIG. 1A illustrates a plan view of a microphone array 1, a plurality of local microphones 3 and a plurality of audio sources 5 which provide a sound space 11. A user 7 is located within the sound space 11. FIG. 1B illustrates a perspective view of the same sound space 11 and user 7. The sound space 11 may comprise an arrangement of audio sources in a three-dimensional space. The sound space 11 may be defined in relation to recording sounds (a recorded sound space) and in relation to rendering sounds (a rendered sound space).

In the example of FIGS. 1A and 1B the audio sources 5A, 5B, 5C may be a band or other group of musicians creating a musical audio recording. In the example of FIGS. 1A and 1B three audio sources 5A, 5B and 5C are provided. The first audio source 5A comprises a vocalist, the second audio source 5B comprises a guitar and the third audio source 5C comprises a drum. It is to be appreciated that other types and numbers of audio sources 5 may be used in other examples of the disclosure. For instance, in some examples only a single audio source 5 might be provided. Also the audio sources 5 could be arranged to create any type of audio signal and not just a musical output.

The microphone array 1 and local microphones 3 may be arranged to enable spatial audio to be captured. The spatial audio comprises an audio signal which can be rendered so that the user 7 can perceive spatial properties of the audio signal. For example the spatial audio may be rendered so that the user 7 can perceive the direction of origin and the distance from an audio source 5. The spatial audio may enable an immersive audio experience to be provided to the user 7. The immersive audio experience could comprise a virtual reality or augmented reality experience or any other suitable experience.

The microphone array 1 comprises one or more microphones. The microphones within the microphone array 1 comprise any suitable means which may be arranged to convert a detected audible signal into a corresponding electrical signal. The microphone array 1 could comprise any suitable type of microphones. In some examples the microphone array 1 may comprise far field microphones. In some examples the microphone array 1 may comprise an OZO device, which comprises eight microphones on a surface that can be approximated as a sphere, or any other suitable microphone array 1.

In the example of FIGS. 1A and 1B the microphone array 1 comprises a plurality of spatially separated microphones which may be arranged to capture spatial audio signals. The microphone array 1 may be located, within the sound space 11, so that it is not in proximity to, or adjacent to, any of the audio sources 5A, 5B, 5C.

The microphone array 1 may be arranged to detect audio signals generated by each of the audio sources 5A, 5B, 5C within the sound space 11. As the microphone array 1 is not in proximity to, or adjacent to, the audio sources 5A, 5B, 5C there is a delay between the audio signal being generated by the audio sources 5A, 5B, 5C and the audio signal being detected by the microphone array 1. This delay will be dependent upon the distance between each of the respective audio sources 5A, 5B, 5C and the microphone array 1.

In the example of FIGS. 1A and 1B three local microphones 3A, 3B and 3C and three audio sources 5A, 5B, 5C are provided. A local microphone 3 is provided for each of the audio sources 5. It is to be appreciated that other numbers of local microphones 3 and audio sources 5 may be provided in other examples of the disclosure.

The local microphones 3 comprise any suitable means which is arranged to convert a detected audible signal into a corresponding electrical signal. The local microphones 3 may comprise a lavalier microphone or any other suitable type of microphones.

Each of the local microphones 3 are positioned in proximity to, or adjacent to, a corresponding audio source 5. The first local microphone 3A is positioned in proximity to the first audio source 5A, the second local microphone 3B is positioned in proximity to the second audio source 5B and the third local microphone 3C is positioned in proximity to the third audio source 5C. The local microphones 3A, 3B, 3C may be arranged to obtain local audio signals. The local audio signals may comprise information representing the audio sources 5. The local audio signals may comprise more information representing the audio sources 5 than the ambient sounds. The local microphones 3A, 3B, 3C may be positioned in proximity to the audio sources 5A, 5B, 5C so that the time between the audio signal being generated by the audio source and the audio signal being detected by the corresponding local microphone 3A, 3B, 3C is negligible.

The local microphones 3 are positioned in proximity to, or adjacent to, the audio sources 5 so that the local microphones 3 are located closer to the audio source than the microphone array 1. This provides a greater separation between the audio source 5 and the microphone array 1 and the audio source 5 and the local microphone 3. The spatial arrangement of the microphone array 1 and local microphones 3A, 3B, 3C create a delay between the time at which the local microphones 3A, 3B, 3C detect an audio signal from a corresponding audio source 5A, 5B, 5C and the time at which the microphone array 1 detects an audio signal from the audio source 5A, 5B, 5C. The delay will be dependent upon the difference in the separation between the audio source 5 and the microphone array 1 and the audio source 5 and the local microphone 3.

The user 7 uses a rendering device 9 to listen to the rendered audio signals. The rendering device 9 comprises any means which may be arranged to convert electrical input signals into audio output signals. In the example of FIGS. 1A and 1B the rendering device 9 comprises a head set or head phones. In some examples rendering device 9 may enable virtual reality or augmented reality content to be rendered for the user 7. For instance, the rendering device 9 may comprise one or more displays arranged to display the virtual reality or augmented reality content.

The user 7 may be free to move within the sound space 11. The user 7 may be able to rotate within the sound space 11 so as to change the relative orientation between the user and the audio sources 5A, 5B, 5C. In some examples the user 7 may be able to move laterally within the sound space 11 so as to change the relative distances between the user 7 and the audio sources 5A, 5B, 5C.

Figure 4:
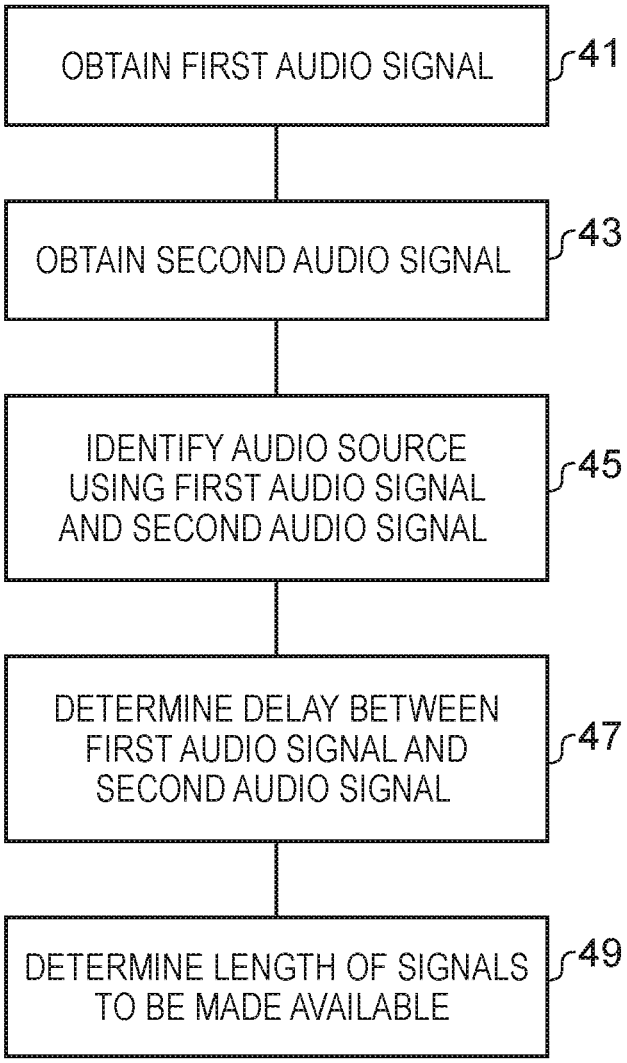
FIG. 4 illustrates a method according to examples of the disclosure.

The audio signals captured by the microphone array 1 and the local microphones 3A, 3B, 3C are processed so that they can be rendered by the rendering device 9. For example the audio signals may be processed so as to provide a spatial audio output. In order to provide the spatial audio output the audio signals that are received at different times must be temporally aligned. The temporal alignment may comprise adding a delay to one or more of the captured audio signals so that the audio signals corresponding to the same audio objects can be combined to provide a spatial audio output. It is necessary to have sufficient lengths of audio signals available for processing to ensure that the audio signals corresponding to the same audio events are available at the same time so that the audio signals are processed correctly. This will require adequate lengths of the audio signals to be available for processing, for example adequate lengths of the audio signals must be stored in a temporary memory. However, if too much of the audio signals is stored in the temporary memory this is an inefficient use of the available memory circuitry. FIG. 4 illustrates an example method which may be used to determine the lengths of audio signals that are needed to enable the different audio signals to be temporally aligned.

Figure 2B:
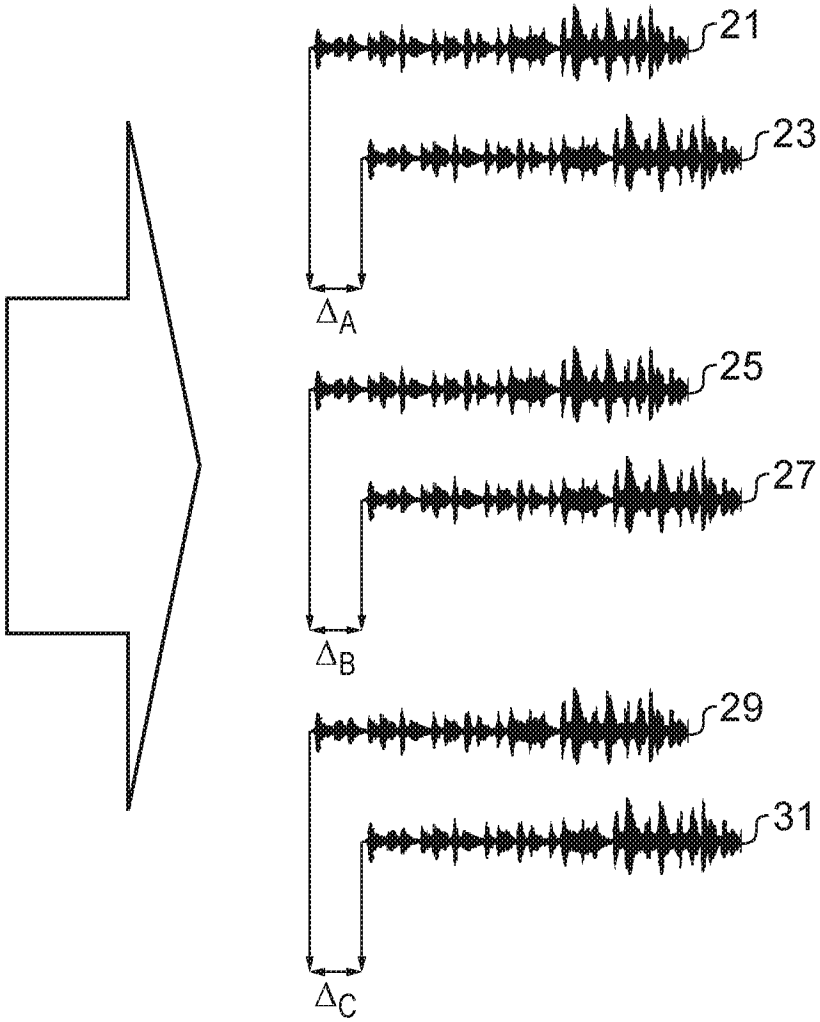
FIGS. 2A and 2B illustrate a plurality of microphones and the delay in the signals captured by the microphones.
Figure 2A:
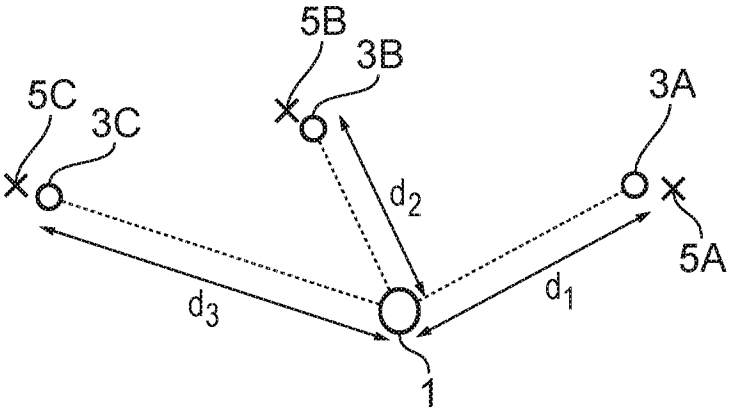

FIGS. 2A and 2B schematically illustrate the microphone array 1 and the plurality of local microphones 3A, 3B, 3C shown in FIG. 1 and the delays in the audio signals captured by the microphone array 1 and the local microphones 3A, 3B, 3C.

FIG. 2A shows the spatial separations between the microphone array 1 and each of the local microphones 3A, 3B, 3C. Each of the local microphones 3A, 3B, 3C is positioned adjacent to a corresponding audio source 5A, 5B, 5C. The position of the microphone array 1 is such that the distance between the local microphones 3A, 3B, 3C and the audio sources 5A, 5B, 5C is less than the distance between the microphone array 1 and the audio sources 5A, 5B, 5C. A distance $d_1$ is provided between the first local microphone 3A and the microphone array 1, a distance $d_2$ is provided between the second local microphone 3B and the microphone array 1 and a distance $d_3$ is provided between the third local microphone 3C and the microphone array 1. The distances $d_1$, $d_2$ and $d_3$ are much larger than the distances between the local microphones 3A, 3B, 3C and the corresponding audio sources 5A, 5B, 5C. For instance the local microphones 3A, 3B, 3C may be positioned within several centimeters of the audio sources while the microphone array 1 could be several meters or tens of meters from the audio sources 5A, 5B, 5C.

FIG. 2B shows the delay in the audio signals captured by the respective microphones which is caused by the spatial separation of the microphones. Signal 21 represents the audio signal captured by the first local microphone 3A and signal 23 represents the audio signal captured by a microphone within the microphone array 1. The audio signals 21, 23 both capture an audio signal generated by the audio source 5A which is positioned adjacent to the first local microphone 3A. The distance $d_1$ between the first local microphone 3A and the microphone array 1 gives rise to a delay of $\Delta A$ in the two signals 21, 23.

Signal 25 represents the audio signal captured by the second local microphone 3B and signal 27 represents the audio signal captured by a microphone within the microphone array 1. The audio signals 25, 27 both capture the audio signal generated by the audio source 5B which is positioned adjacent to the second local microphone 3B. The distance $d_2$ between the second local microphone 3B and the microphone array 1 gives rise to a delay of ΔB in the two signals 25, 27.

Signal 29 represents the audio signal captured by the third local microphone 3C and signal 31 represents the audio signal captured by a microphone within the microphone array 1. The audio signals 29, 31 both capture the audio signal generated by the audio source 5C which is positioned adjacent to the third local microphone 3C. The distance $d_3$ between the third local microphone 3C and the microphone array 1 gives rise to a delay of ΔC in the two signals 29, 31.

The magnitude of the delays ΔA, ΔB, ΔC are determined by the magnitude of the distances $d_1$, $d_2$, $d_3$ and the speed of propagation of the audio signal. It is to be appreciated that there may be additional delays that need to be taken into account when determining the length of the audio signals that must be available for processing, for example any jitter in the transmission of the audio signals must also be accounted for.

Figure 3B:
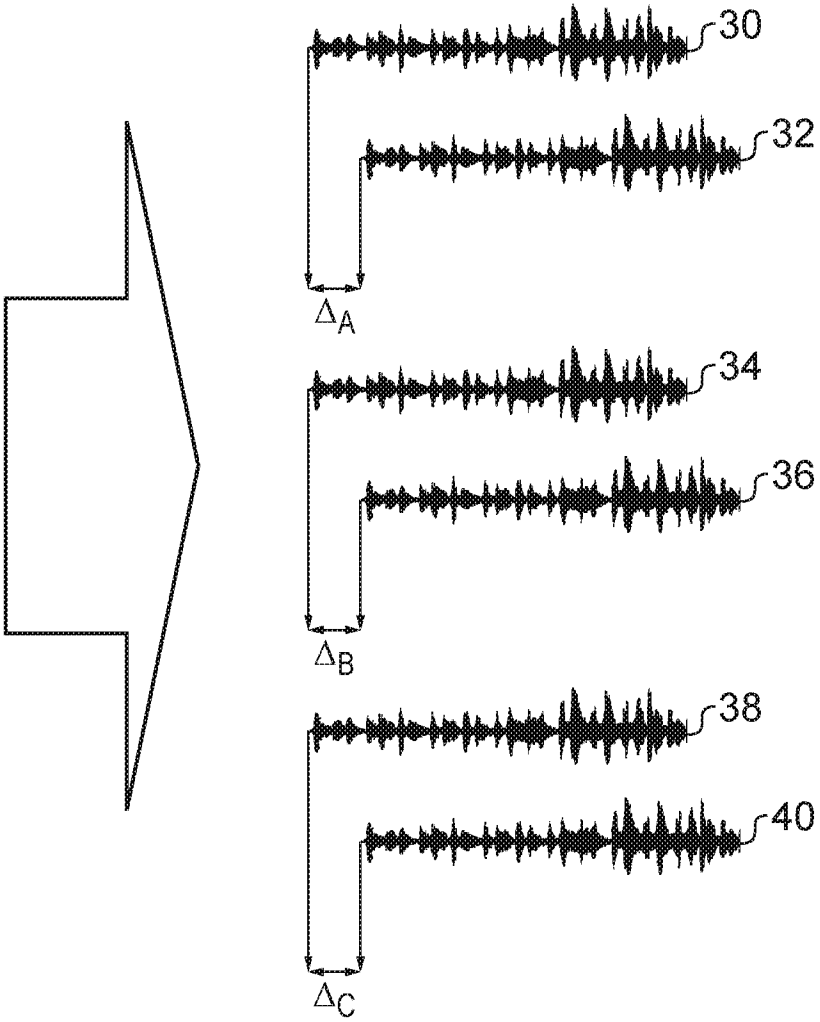
FIGS. 3A and 3B illustrate another plurality of microphones and the delay in the signals captured by the microphones.
Figure 3A:
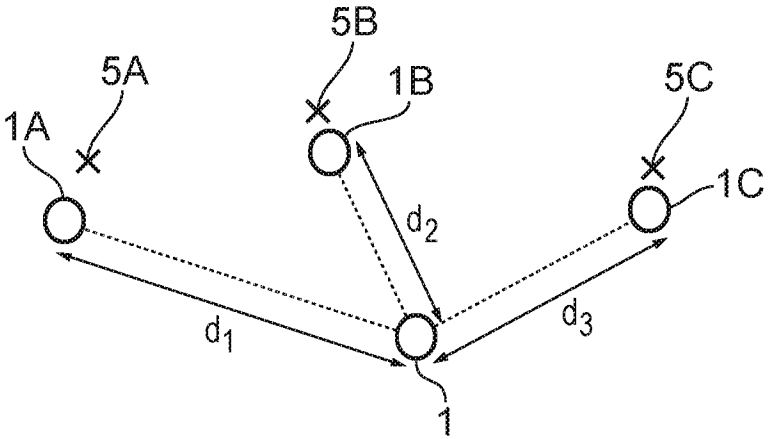

FIGS. 3A and 3B schematically illustrate an alternative arrangement for microphones and audio sources 5. In the arrangement of FIGS. 3A and 3B the system comprises a plurality of microphone arrays 1, 1A, 1B, 1C. Three of the microphone arrays 1A, 1B, 1C are positioned adjacent to a corresponding audio source 5A, 5B, 5C so that they provide local microphone arrays 1A, 1B, 1C. The other microphone array 1 is positioned so that it is not close to any of the audio sources 5A, 5B, 5C. The other microphone array 1 may be a far field microphone array 1. In the example of FIG. 3A four microphone arrays 1, 1A, 1B, 1C are provided. It is to be appreciated that other numbers and/or arrangements of microphone arrays 1 could be provided in other examples of the disclosure.

FIG. 3A shows the spatial separation between the microphone array 1 and the local microphone arrays 1A, 1B, 1C. The position of the microphone array 1 is such that the distance between the local microphone arrays 1A, 1B, 1C and the respective audio sources 5A, 5B, 5C is less than the distance between the microphone array 1 and the audio sources 5A, 5B, 5C.

A distance $d_1$ is provided between the first local microphone array 1A and the far field microphone array 1, a distance $d_2$ is provided between the second local microphone array 1B and the far field microphone array 1 and a distance $d_3$ is provided between the third local microphone array 10 and the far field microphone array 1. The distances $d_1$, $d_2$ and $d_3$ may be much larger than the distances between the local microphone arrays 1A, 1B, 1C and the corresponding audio sources 5A, 5B, 5C. For instance the local microphone arrays 1A, 1B, 1C may be positioned within several centimeters of the audio sources 5A, 5B, 5C while the far field microphone array 1 could be several meters or tens of meters from the audio sources 5A, 5B, 5C.

FIG. 3B shows the delay in the audio signals captured by the respective microphone arrays 1, 1A, 1B, 1C which is caused by the spatial separation of the microphone arrays 1, 1A, 1B, 1C. Signal 30 represents the audio signal captured by the first local microphone array 1A and signal 32 represents the audio signal captured by the far field microphone array 1. The audio signals 30, 32 both represent an audio signal generated by the audio source 5A which is positioned adjacent to the first local microphone array 1A. The distance d1 between the first local microphone array 1A and the far field microphone array 1 gives rise to a delay of M in the two signals 30, 32.

Signal 34 represents the audio signal captured by the second local microphone array 1B and signal 36 represents the audio signal captured by the far field microphone array 1. The audio signals 34, 36 both represent an audio signal generated by the audio source 5B which is positioned adjacent to the second local microphone array 1B. The distance $d_2$ between the second local microphone array 1B and the far field microphone array 1 gives rise to a delay of ΔB in the two signals 34, 36.

Signal 38 represents the audio signal captured by the third local microphone array 10 and signal 40 represents the audio signal captured by the far field microphone array 1. The audio signals 38, 40 both represent an audio signal generated by the audio source 5C which is positioned adjacent to the third local microphone array 10. The distance $d_3$ between the second third microphone array 1C and the far field microphone array 1 gives rise to a delay of ΔC in the two signals 38, 40.

FIG. 4 illustrates a method of audio of processing. The method of FIG. 4 may enable the lengths of audio signals required to be made available for processing to be determined. In some examples the method may enable the lengths of audio signals required to be made available for processing so as to provide a spatial audio output to be determined. The method of FIG. 4 could be implemented using the microphones 1, 3A, 3B, 3C and sound spaces as described above.

The example method of FIG. 4 comprises, at block 41, obtaining a first audio signal from at least a first microphone 1 located at a first distance from an audio source 5. The first microphone may be located within a microphone array 1. The microphone array 1 could be a far field microphone array 1. The microphone array 1 may comprise a plurality of microphones so that a plurality of audio signals may be obtained from the plurality of microphones within the microphone array 1.

At block 43 the method comprises obtaining a local audio signal from a local microphone 3 wherein the local microphone 3 is located closer to the audio source 5 than the first microphone 1. The local microphone 3 may be located in close proximity to the audio source 5. The distance between the local microphone 3 and the microphone array 1 may be several times larger than the distance between the local microphone 3 and the audio source 5. This may result in a perceptible delay between the audio signals detected by the microphone array 1 and the audio signals detected by the local microphone 3.

In some examples of the method obtaining an audio signal may comprise the capture of the audio signal by one or more microphones 1, 3A, 3B, 3C. In some examples the obtaining of the audio signal may comprise receiving a signal from the microphone indicative of the captured audio signal. For example a processing device may obtain audio signals by receiving signals that have been captured by one or more remote microphones.

At block 45 the method comprises identifying the audio source 5 using the first audio signal and the local audio signal. Any suitable methods may be used to identify the audio source 5 from the respective signals. In some examples the audio source may be identified by identifying corresponding features in the audio signals detected by the respective microphones 1, 3.

At block 47 the method comprises using the identified audio source to determine a delay between the first audio signal and the local audio signal. Once an audio source has been identified the respective delays in the signals corresponding to that audio source can be identified. Any suitable process may be used to determine the delay between the first audio signal and the local audio signal. In some examples the delay may be determined with respect to one or more reference points.

In some examples the process of determining the delay may take into account the propagation delay between the obtained audio signals. The propagation delay may arise from the difference in separation of the microphone array 1 and the local microphones 3 and the audio sources 5. In some examples the process may also take into account other sources of delay. For example the process may take into account any jitter in the transmission of the obtained audio signals or any other relevant source of delay.

At block 49 the method comprises using the determined delay to determine the length of the first audio signal and the local audio signal to be made available for processing so as to enable temporal alignment of at least the first audio signal and the local audio signal.

The lengths of audio signals that are to be made available is sufficiently long so that corresponding features are present in both the length of the first signal obtained by the first microphone 1 and the length of the local signal obtained by the local microphone 3. This requires there to be an overlap in the audio signals stored in the temporary memory so that the same features captured by the different microphones 1, 3 can be combined. This ensures that the signals received from the local microphones 3 are not processed before the delayed signals from the microphone array 1 are received.

The first audio signal and the local audio signal may be made available for processing in any suitable manner. In some examples the first audio signal and the local audio signal may be made available for processing by being stored in a temporary memory. In other examples the first audio signal and the local audio signal may be made available for processing by being transmitted to another device.

The temporal alignment may enable an immersive audio output, such as a spatial audio output, to be rendered to one or more users 7. The immersive audio output could be a virtual reality or an augmented reality output. The one or more users could be located at different locations within a sound space 11 or within different sound spaces.

The example method of FIG. 4 could be performed by any suitable device. In some examples the method could be performed by an audio capture device. For example it may be performed by a device associated with the microphone array 1 or the close up microphones 3. In some examples the method may be performed by a rendering device 9. In some examples the method could be performed by a processing device 63 which may be located remotely to the microphone array 1 and the close up microphones 3 and may also be located remotely from the rendering device 9. In some examples parts of the method may be performed by distributed devices so that different parts of the method may be performed by different devices.

Figure 5A:
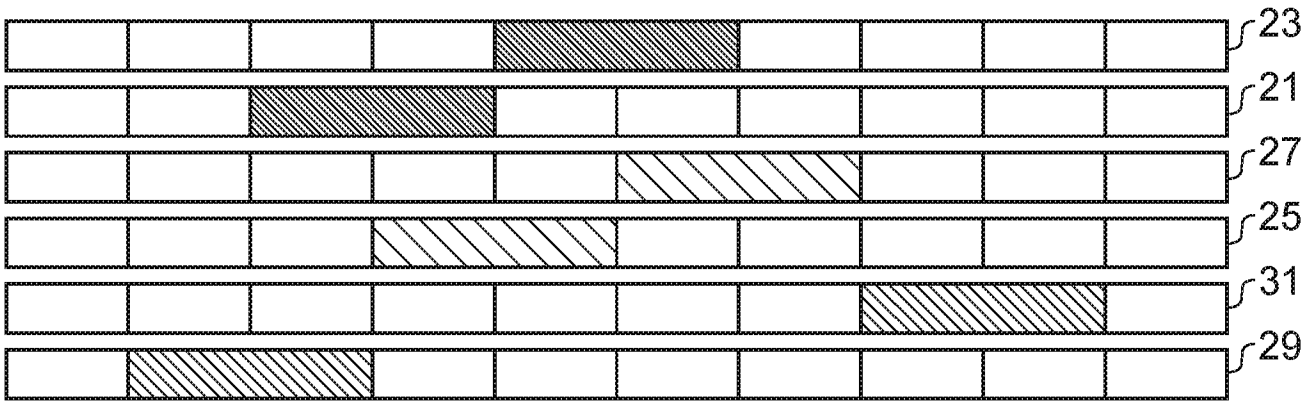
FIGS. 5A and 5B illustrate an example of temporal alignment of the audio signals.
Figure 5B:
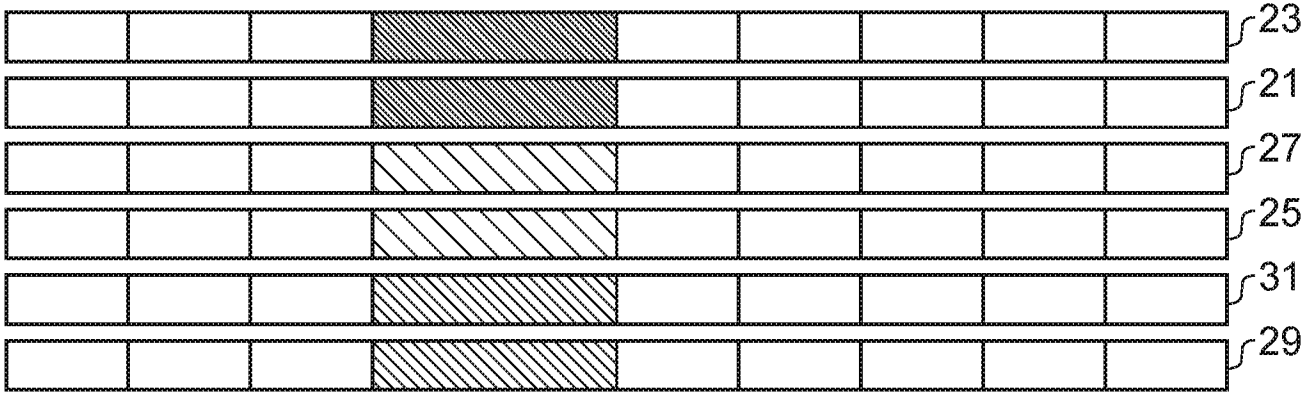

FIGS. 5A and 5B schematically illustrate the temporal alignment of the signals obtained by the microphones 3A, 3B, 3C and the microphone arrays 1. The signals may have been transmitted to a remote processing device 63. FIG. 5A illustrates the signals before they have been temporally aligned and FIG. 5B illustrates the signals after they have been temporally aligned. The signals may have been captured by a plurality of local microphones 3A, 3B, 3C and a microphone array 1 as shown in FIG. 2A or by any other suitable arrangement of microphones.

In FIG. 5A signal 21 represents a length of the audio signal 21 captured by the first local microphone 3A and signal 23 represents a length the audio signal 27 captured by the microphone array 1. These signals represent a first audio source 5A. As the microphone array 1 is located further away from the audio source 5A there is a delay in the audio signal 23 captured by the microphone array 1 compared to the audio signal 23 captured by the first local microphone 3A. There may also be delay caused by jitter when the audio signals are transmitted from the microphones 1, 3A to the processing device 63.

Signal 25 represents a length of the audio signal 25 captured by the second local microphone 3B and signal 27 represents a length of the audio signal 27 captured by the microphone array 1. These signals represent a second audio source 5B. As the microphone array 1 is located further away from the audio source 5B there is a delay in the audio signal 27 captured by the microphone array 1 compared to the audio signal 25 captured by the second local microphone 1B.

Both the audio signal 25 captured by the second local microphone 3B and the audio signal 27 captured by the microphone array 1 representing the second audio source 5B are delayed with respect to the audio signals 21, 23 representing the first audio source 5A. This delay could be caused by jitter within the system, the spatial separation of the microphones 1, 3A, 3B and audio sources 5A, 5B or any other factors.

Signal 29 represents a length of the audio signal 21 captured by the third local microphone 3C and signal 31 represents a length of the audio signal 31 captured by the microphone array 1. These signals represent a third audio source 5C. As the microphone array 1 is located further away from the audio source 5C there is a delay in the audio signal 31 captured by the microphone array 1 compared to the audio signal 29 captured by the first local microphone 1A. The delay between the audio signals 29, 31 corresponding to the third audio source 5C is greater than the delays between the other audio signals 21, 23, 25, 27. This difference in the delays could be due to the microphone array 1 being located further away from the third audio source 5C than from the other audio sources 5A, 5B. In some examples the delay could be due to increased jitter in the system.

The audio signal 31 captured by the microphone array 1 which represents the third audio source 5C is delayed with respect to all of the other audio signals 21, 23, 25, 27, 29. This audio signal 31 is the last to be obtained. The audio signal 29 which is received by the third local microphone 3C is the first audio signal which is obtained. All of the other audio signals 21, 23, 25, 27, 31 are delayed in time with respect to the audio signal 29 from the third local microphone 3C.

In order to enable the respective audio signals 21, 23, 25, 27, 29, 31 to be temporally aligned a sufficient length of each of the audio signals must be made available. The lengths of the audio signals must be such that information relating to the audio sources must be available in both the length of the audio signal obtained from the local microphones 3A, 3B, 3C and the length of the audio signal obtained from the microphone array 1. The length of the audio signals that are required is dependent upon the delays between the respective audio signals. This may be affected by the distances between the local microphone array 1 and the local microphones 3A, 3B, 3C, the amount of jitter within the system or any other factors.

FIG. 5B represents the respective lengths of the audio signals 21, 23, 25, 27, 29, 31 after they have been temporally aligned. The temporal alignment may comprise applying a delay to one or more of the captured audio signals 21, 23, 25, 27, 29, 31. Any suitable process may be used to temporally align the signals.

Figure 6A:
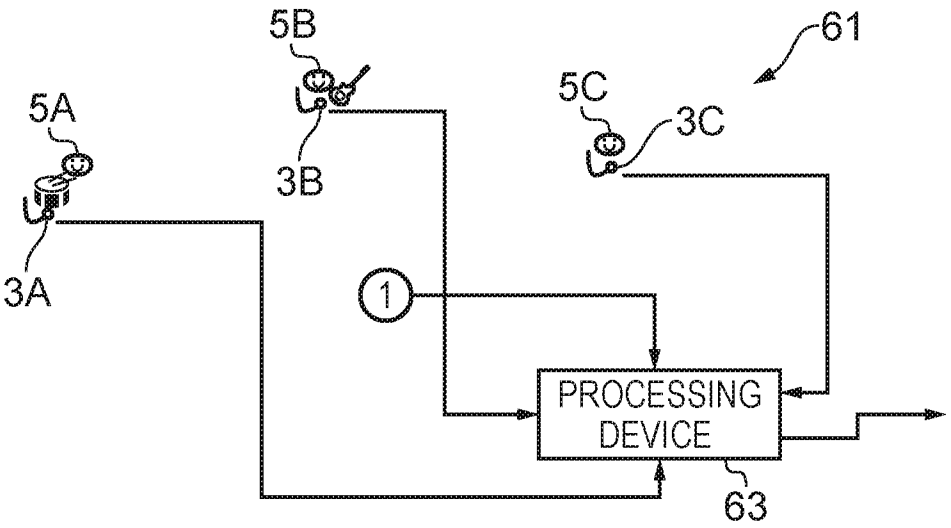
FIGS. 6A and 6B illustrate a system and method for audio processing.
Figure 6B:
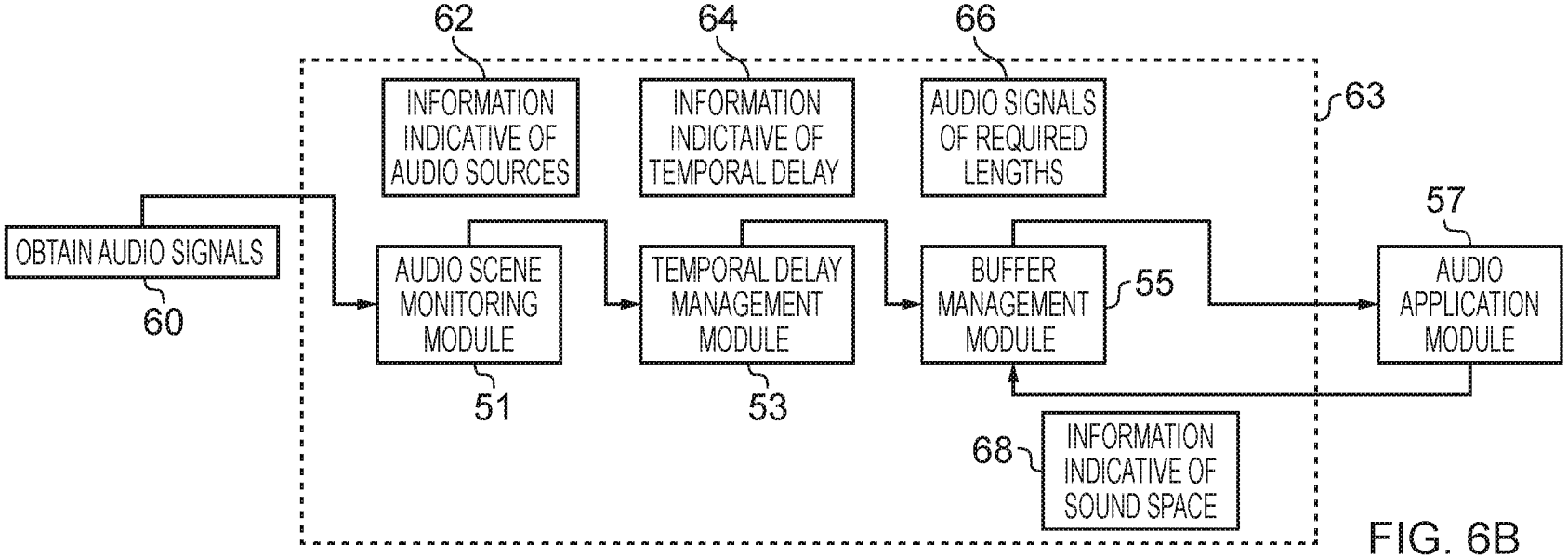

FIG. 6A illustrates a system 61 for audio processing and FIG. 6B illustrates a method of audio processing which may be implemented by the system 61.

The example system of FIG. 6A comprises a microphone array 1 and a plurality of local microphones 3A, 3B, 3C. The local microphones 3A, 3B, 3C may be positioned adjacent to audio sources 5A, 5B, 5C as described above.

The example system 61 of FIG. 6A also comprises a processing device 63. The processing device 63 may comprise means for obtaining the audio signals from the plurality of microphones 1, 3A, 3B, 3C. The means for obtaining the audio signals could comprise a communications interface which may comprise one or more transceivers. The communications interface could enable wireless communications between the processing device 63 and the plurality of microphones 1, 3A, 3B, 3C. The wireless communication could comprise Bluetooth, Bluetooth Low Energy, Bluetooth Smart, 6LoWPan ($IP_v6$ over low power personal area networks) ZigBee, ANT+, near field communication (NFC), Radio frequency identification, wireless local area network (wireless LAN) or any other suitable protocol. In other examples the communications interface could enable wired communications between the processing device 63 and one or more respective microphones 1, 3A, 3B, 3C.

The wireless communication links could introduce jitter or other delay into the audio signals received by the processing device 63. The jitter may affect the time of arrival of individual packets of the wireless communication systems. The jitter may be inherent within the wireless communication system. The delays caused by the jitter may be in addition to the delays caused by the distances between the respective microphones 1, 3A, 3B, 3C.

The processing device 63 may comprise controlling circuitry 93 which is arranged to obtain the audio signals from the respective microphones 1, 3A, 3B, 3C and use the audio signals to identify an audio source. The controlling circuitry 93 may be arranged to use the identified audio source to determine the delay between the respective audio signals and use the determine delay to determine the length of respective audio signals to be made available for processing. For instance, the processing device 63 could implement the example method of FIG. 4.

The processing device 63 may comprise any suitable device. In the example system of FIG. 6 the processing device 63 is located remote from the microphone array 1 and the local microphones 3A, 3B, 3C. In such cases the processing device 63 is a separate device to the microphone array 1 and the local microphones 3A, 3B, 3C. The processing device could be a computer, tablet, mobile phone or a plurality of such interconnected devices or any other suitable devices. In such examples the processing device 63 may be arranged to transmit the spatial audio signal to a rendering device 9. In other examples the processing device 63 could be provided within a rendering device 9 or within a device comprising one or more microphones 1, 3A, 3B, 3C. In some examples the processing device 63 may be provided as a single device. In other examples the processing device 63 could be distributed across multiple entities.

The processing device 63 may be arranged to process the audio signals. For example the processing device 63 may be arranged to temporally align the audio signals. In some examples the processing device 63 may be arranged to process the audio signals so as to provide a spatial audio signal to a rendering device. In other examples the processing device 63 could be arranged to control the lengths of the audio signals that are made available for processing and then transmit the audio signals to a further device to enable the spatial processing.

FIG. 6B illustrates a method of processing the audio signals which may be implemented using the processing device 63.

At block 60 the method comprises obtaining the audio signals. The obtained audio signals comprise at least a first audio signal received from the microphone array 1 and one or more local audio signals received from the one or more local microphones 3A, 3B, 3C. The obtained audio signals are generated by the respective audio sources and detected by the respective microphones 1, 3A, 3B, 3C.

In some examples the method may also comprise obtaining spatial information. The spatial information could comprise information about the relative locations of the audio sources 5A, 5B, 5C and the local microphones 3A, 3B, 3C and the microphone array 1. In some examples spatial information may be received with the audio signals. For instance, the local microphones 3A, 3B, 3C and/or the microphone array 1 may provide information indicative of their own location together with the audio signals.

The spatial information may be obtained using any suitable methods. In some examples the spatial information could be obtained using HAIP (high accuracy indoor positioning) or any other suitable tracking process. In some examples one or more of the local microphones 3A, 3B, 3C and/or the microphone array 1 may be in a fixed location. This fixed location could be known to the processing device 63. In some examples one or more of the local microphones 3A, 3B, 3C and/or the microphone array 1 may be moveable. In such examples information relating to the movements of the local microphones 3A, 3B, 3C and/or the microphone array 1 may be made available to the processing device 63.

The obtained audio signals are provided to an audio scene monitoring module 51. The audio scene monitoring module 51 comprises any means which may be arranged to monitor a sound space 11 and any changes within the sound space 11. For example the audio scene monitoring module 51 may be arranged to track the positions of the audio sources 5A, 5B, 5C and the corresponding local microphones 3A, 3B, 3C and monitor any change in their positions within the sound space 11. In some examples the audio scene monitoring module 51 may be arranged to track the position of a user 7 and the position of the user relative to the sound sources 5A, 5B, 5C.

The audio scene monitoring module 51 may be arranged to determine which audio sources 5A, 5B, 5C are of interest to a user and so need to been taken into account when the lengths of audio signals needed is being determined. For instance, only audio sources within a specific radius of the user 7 may need to be taken into account for the audio processing. In some examples all of the sources around the user 7 might need to be taken into account for the audio processing. As a user 7 moves through a sound space 11 the audio sources 5A, 5B, 5C of interest may change.

At block 62 the audio scene monitoring module 51 provides information indicative of the audio sources 5A, 5B, 5C of interest and their relative positions. The audio scene monitoring module 51 may use the spatial information provided with the audio signals, and any other suitable information, to determine the audio sources 5A, 5B, 5C of interest and their relative positions.

The information indicative of the audio sources 5A, 5B, 5C of interest and their relative positions is provided to a temporal delay measurement module 52. The temporal delay measurement module 52 may comprise any means which may be arranged to determine the delay between signals received by the local microphones 3A, 3B, 3C and signals received by the microphone array 1. The temporal delay management module 52 may be arranged to identify the audio sources 5A, 5B, 5C within the obtained audio signals and use the identified audio sources 5A, 5B, 5C to determine the delays.

At block 64 the temporal delay management module 53 provides information indicative of the temporal delay between different audio signals captured by different microphones 1, 3A, 3B, 3C. The temporal delay may be measured with respect to a reference point. The reference point could be the position of the microphone array 1, the position of the user 7 or any other suitable reference point. The temporal delay management module 52 may be arranged to provide information indicative of the delay between different local audio signals and/or information about the delay between local audio signals and audio signals obtained by the microphone array 1.

The delays between the respective audio signals may comprise the propagation delays caused by the distances between the microphones 1, 3A, 3B, 3C and also the delays caused by jitter within the communication system. The temporal delay management module 53 may be arrange to account for both of these different types of delays in single measurement.

The information indicative of the temporal delay between different audio signals is provided to a buffer management module 55. The buffer management module 55 may comprise any means which may be arranged to control the length of the audio signals that are made available for processing. In the example of FIG. 6B the buffer management module 55 may control the length of the audio signals that are stored in a temporary memory such as a buffer. In other examples the buffer management module 55 could control the length of the audio signals that are transmitted to a processing device.

The buffer management module 55 may be arranged to use any suitable processes to determine the length of the audio signals that are to be made available for processing. The length of the audio signals that are required may be dependent upon propagation delays between the audio signals, jitter within the system 61, the size of the sound space 11, the position of the user 7 within the sound space 11, movement of the user 7 within the sound space 11, movement of one or more of the audio sources 5A, 5B, 5C within the sound space 11 or any other suitable factor.

In the example of FIG. 6B the buffer management module 55 is arranged to determine the amount of storage that needs to be allocated within a temporary memory so as to enable the required lengths of the audio signals to be available for processing.

The amount of temporary memory storage M required for each audio source 5A, 5B, 5C may be given by:

$$M=(1+\text{jitter budget})(\text{bitrate per audio source})(\text{temporal delay})$$

where the jitter budget is the amount of jitter which can be expected within the system 61 and the temporal delay is the delay between the audio signals which is caused by the spatial separation of the microphones 1, 3A, 3B, 3C.

The buffer management module 55 may work out the total amount of storage required by summing the values of M for each of the audio sources of interest. Audio signals which correspond to audio sources 5 that are not of interest need not be made available for processing.

At block 66 the required lengths of audio signals are provided. The required lengths of the audio signals may be provided to an audio application module 57. The audio application module 57 may be arranged to process the lengths of the audio signals to temporally align the audio signals. The temporally aligned audio signals could be used to provide a spatial audio output or any other suitable type of audio output.

In the example of FIG. 6B the audio application module 57 may be provided within a separate device to the processing device 63. For instance the audio application module 57 could be provided within a rendering device 9. In other example the audio application module 57 could be provided within the processing device 63.

The audio application module 57 may be arranged to provide feedback to the buffer management module 55. In the example of FIG. 6B, at block 68, the audio application module 57 provides information indicative of the sound space 11 of interest to the user 7. The sound space 11 which is of interest to the user may change as the user moves. The audio application module 57 may use the updated information about the sound space of interest to work out the delays in the audio signals and to allocate the required amount of temporary memory storage.

In some examples the audio application module 57 may provide information indicative of the length of the audio signals to be made available for processing to the processing device 63. For instance, the audio application module 57 may be arranged to determine the audio sources within the audio signals and determine the length of the audio signals required to enable the spatial processing of such signals.

Figure 7:
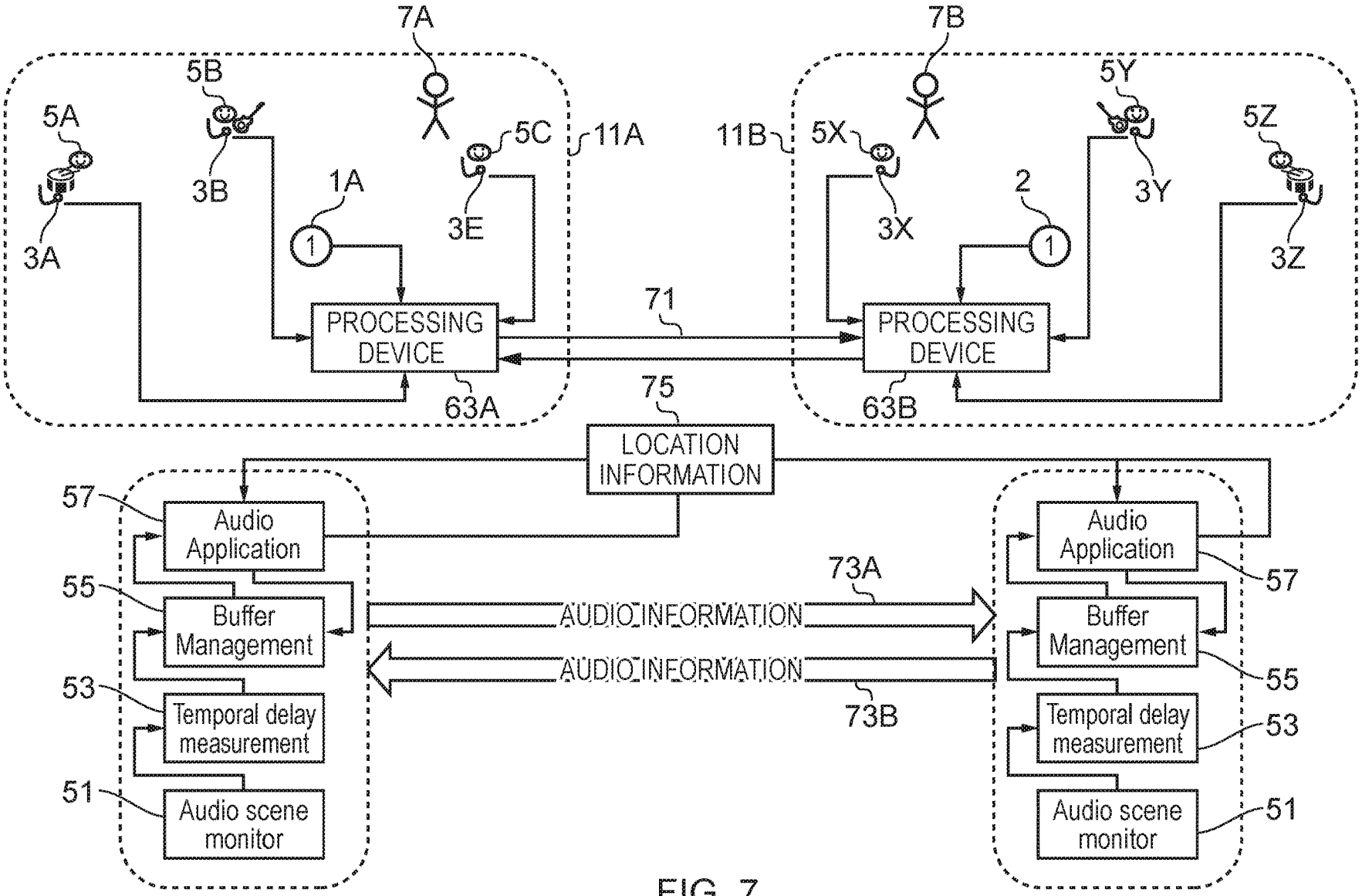
FIG. 7 illustrates a system in which the audio content is rendered for a plurality of users.

FIG. 7 illustrates another system 71 which may be used for audio processing according to examples of the disclosure. The system 71 of FIG. 7 may enable conversational applications to be implemented. The conversational application may comprise a first user 7A in a first sound space 11A conversing, via a communication link 71, with a second user 7B in a second sound space 11B.

In the example of FIG. 7 the first sound space 11A comprises three audio sources 5A, 5B, 5C. Three local microphones 3A, 3B, 3C are located adjacent to the corresponding audio sources 5A, 5B, 5C and a microphone array 1A is provided separated from the local microphones 3A, 3B, 3C. The audio signals obtained by the microphones 1A, 3A, 3B, 3C are provided to a processing device 63A. The processing device 63A comprises an audio scene monitoring module 51, a temporal delay measurement module 53, a buffer management module 55 and an audio application module 57 which may be as described above.

The second sound space 11B also comprises three audio sources 5X, 5Y, 5Z. Three local microphones 3X, 3Y, 3Z are located adjacent to the corresponding audios sources 5X, 5Y, 5Z and a microphone array 1Z is provided separated from the local microphones 3X, 3Y, 3Z. The audio signals obtained by the microphones 1Z, 3X, 3Y, 3Z are provided to a processing device 63B. The processing device 63B ALSO comprises an audio scene monitoring module 51, a temporal delay measurement module 53, a buffer management module 55 and an audio application module 57 which may be as described above.

The communication link 71 could be a long range communication link such as cellular communication link, an internet connection or any other suitable type of communication link. The communication link 71 may enable audio content from the first sound space 11A to be provided to second user 7B in the second sound space 11B and may also enable audio content from the second sound space 11B to be provided to the first user 7A in the first sound space 11A. For example the first user 7A and the second user 7B may be communicating via a conversation application. The conversation application may enable an immersive audio call. This may require the audio content from both of the sound space 11A, 11B to be aligned before being rendered to the users 7A, 7B.

In order to enable immersive audio content to be render to the users 7A, 7B the audio information 73A from the first sound space 11A is sent from the first processing device 63A to the second processing device 63B. Similarly the audio information 73A from the second sound space 11B is sent from the second processing device 63B to the first processing device 63A. The audio information 73A, 73B may comprise the audio signals that are captured by the microphones. The audio information 73A, 73B may comprise the lengths of the audio signals that are required so as to enable spatial audio content to be rendered. The lengths of the audio signals that are required may take into account jitter within the communication links between the first processing device 63A and the second processing device 63B.

In the example of FIG. 7 location information is also transferred from the first processing device 63A to the second processing device 63B. The location information may comprise information relating to the locations of the users 7A, 7B within the respective sound spaces 11A, 11B. In some examples the location information 75 may comprise information relating to the sound sources 5 that are of interest for a given user 7A, 7B. Only sound sources 5 that are within a particular radius of the user 7A, 7B may be determined to be of interest.

Figure 8:
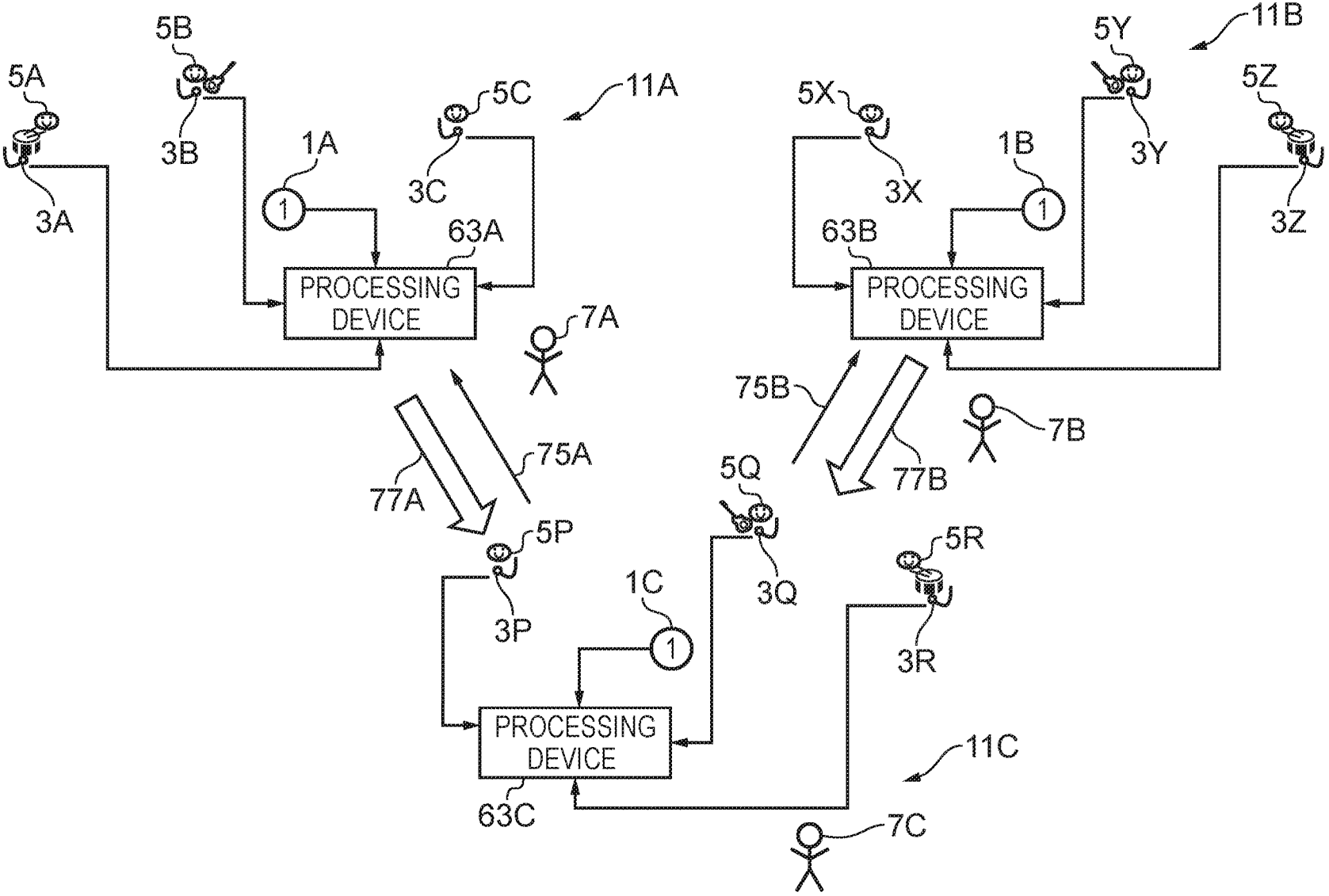
FIG. 8 illustrates a system in which the audio content is rendered for a plurality of users.

FIG. 8 illustrates a system in which the audio content is rendered for a plurality of users 7A, 7B, 7C located in a plurality of different sound spaces 11A, 11B, 11C. In the example of FIG. 8 the first sound space 11A comprises three audio sources 5A, 5B, 5C. Three local microphones 3A, 3B, 3C are located adjacent to the corresponding audio sources 5A, 5B, 5C and a microphone array 1A is provided separated from the local microphones 3A, 3B, 3C. The audio signals obtained by the microphones 1A, 3A, 3B, 30 are provided to a processing device 63A. The second sound space 11B comprises three audio sources 5X, 5Y, 5Z. Three local microphones 3X, 3X, 3Z are located adjacent to the corresponding audio sources 5X, 5Y, 5Z and a microphone array 1B is provided separated from the local microphones 3X, 3Y, 3Y. The audio signals obtained by the microphones 1B, 3X, 3Y, 3Z are provided to a processing device 63B. The third sound space 11C also comprises three audio sources 5P, 5Q, 5R. Three local microphones 3P, 3Q, 3R are located adjacent to the corresponding audio sources 5P, 5Q, 5R and a microphone array 10 is provided separated from the local microphones 3P, 3Q, 3R. The audio signals obtained by the microphones 10, 3P, 3Q, 3R are provided to a processing device 63C.

In the example of FIG. 8 the users 7A, 7B, 7C may be communicating via a conversation application. The conversation application may enable an immersive audio call between the plurality of users 7A, 7B, 7C. This may require the audio content from to different sound spaces 11A, 11B, 11C to be aligned before being rendered to the users 7A, 7B, 7C.

In order to enable the alignment of the audio content location information 75 may be exchanged between the processing devices 63A, 63, 6C associated with the respective users 7A, 7B, 7C. As shown in FIG. 8 the third processing device 63C provides location information 75A, 75B to the first processing device 63A and the second processing device 63B. This location information 75A, 75B may comprise information indicative of the sound sources 5 of interest. The first processing device 63A and the second processing device 63B provide information 77A, 77B indicative of the jitter in the communication link between the respective processing devices to the third processing device 63C. This information can then be used by the third processing device 63A to determine the length of the audio signals that are required to be made available for audio processing. In some examples information indicative of the length of the audio signals that are to be made available for audio processing may be sent from the third audio processing device 63C to the other processing devices 63A, 63B.

In FIG. 8 only information exchanged between the third processing device 63C and the first and second processing devices 63A, 63B is shown. This information enables the third processing device 63C to calculate the length of the audio signals required to be made available for audio processing. It is to be appreciated that corresponding information would be exchanged between the other processing devices 63A, 63B.

Figure 9:
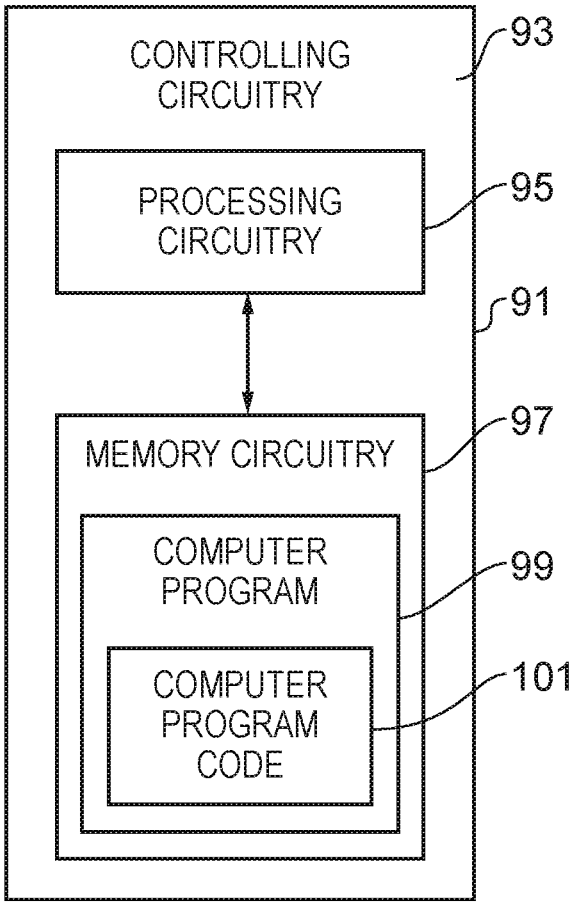
FIG. 9 schematically illustrates an apparatus according to examples of the disclosure.

FIG. 9 schematically illustrates an apparatus 91 according to examples of the disclosure. The apparatus 91 illustrated in FIG. 9 may be a chip or a chip-set. In some examples the apparatus 91 may be provided within devices such as a processing device 63. In some examples the apparatus 91 may be provided within an audio capture devices or an audio rendering device.

The apparatus 91 comprises controlling circuitry 93. The controlling circuitry 93 may provide means for controlling an electronic device such as processing device 63 or a rendering device. The controlling circuitry 93 may also provide means for performing the methods or at least part of the methods of examples of the disclosure.

The apparatus 91 comprises processing circuitry 95 and memory circuitry 97. The processing circuitry 95 may be configured to read from and write to the memory circuitry 97. The processing circuitry 95 may comprise one or more processors. The processing circuitry 95 may also comprise an output interface via which data and/or commands are output by the processing circuitry 95 and an input interface via which data and/or commands are input to the processing circuitry 95.

The memory circuitry 97 may be configured to store a computer program 99 comprising computer program instructions (computer program code 101) that controls the operation of the apparatus 91 when loaded into processing circuitry 95. The computer program instructions, of the computer program 99, provide the logic and routines that enable the apparatus 91 to perform the example methods described above. The processing circuitry 95 by reading the memory circuitry 97 is able to load and execute the computer program 99.

The memory circuitry 97 may comprise temporary memory circuitry. The temporary memory circuitry may comprise one or more buffers or any other suitable temporary memory circuitry.

The computer program 99 may arrive at the apparatus 91 via any suitable delivery mechanism. The delivery mechanism may be, for example, a non-transitory computer-readable storage medium, a computer program product, a memory device, a record medium such as a compact disc read-only memory (CD-ROM) or digital versatile disc (DVD), or an article of manufacture that tangibly embodies the computer program. The delivery mechanism may be a signal configured to reliably transfer the computer program 99. The apparatus may propagate or transmit the computer program 99 as a computer data signal. In some examples the computer program code 99 may be transmitted to the apparatus 91 using a wireless protocol such as Bluetooth, Bluetooth Low Energy, Bluetooth Smart, 6LoWPan ($IP_v6$ over low power personal area networks) ZigBee, ANT+, near field communication (NFC), Radio frequency identification, wireless local area network (wireless LAN) or any other suitable protocol.

Although the memory circuitry 97 is illustrated as a single component in the figures it is to be appreciated that it may be implemented as one or more separate components some or all of which may be integrated/removable and/or may provide permanent/semi-permanent/dynamic/cached storage.

Although the processing circuitry 95 is illustrated as a single component in the figures it is to be appreciated that it may be implemented as one or more separate components some or all of which may be integrated/removable.

References to "computer-readable storage medium", "computer program product", "tangibly embodied computer program" etc. or a "controller", "computer", "processor" etc. should be understood to encompass not only computers having different architectures such as single/multi-processor architectures, Reduced Instruction Set Computing (RISC) and sequential (Von Neumann)/parallel architectures but also specialized circuits such as field-programmable gate arrays (FPGA), application-specific integrated circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term "circuitry" refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of "circuitry" applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

Examples of the disclosure enable efficient resource allocation for audio processing. This may be particularly beneficial in devices with limited resources such as mobile communication devices. This may also reduce the amount of memory circuitry required, and so the overall cost, for other types of processing devices.

The term "comprise" is used in this document with an inclusive not an exclusive meaning. That is any reference to X comprising Y indicates that X may comprise only one Y or may comprise more than one Y. If it is intended to use "comprise" with an exclusive meaning then it will be made clear in the context by referring to "comprising only one" or by using "consisting".

In this brief description, reference has been made to various examples. The description of features or functions in relation to an example indicates that those features or functions are present in that example. The use of the term "example" or "for example" or "may" in the text denotes, whether explicitly stated or not, that such features or functions are present in at least the described example, whether described as an example or not, and that they can be, but are not necessarily, present in some of or all other examples. Thus "example", "for example" or "may" refers to a particular instance in a class of examples. A property of the instance can be a property of only that instance or a property of the class or a property of a sub-class of the class that includes some but not all of the instances in the class. It is therefore implicitly disclosed that a features described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A method comprising:

obtaining a first audio signal from at least a first microphone located at a first distance from an audio source;

obtaining a local audio signal from a local microphone wherein the local microphone is located closer to the audio source than the first microphone;

identifying the audio source using the first audio signal and the local audio signal;

using the identified audio source to determine a delay between the first audio signal and the local audio signal; and using:

the determined delay, and at least one parameter, related to a bitrate associated with the identified audio source, to determine a length of the first audio signal and the local audio signal to be made available for processing, wherein the determined length is configured to enable temporal alignment of at least the first audio signal and the local audio signal.

2. The method as claimed in claim 1, wherein the first microphone is part of a microphone array comprising a plurality of microphones arranged to capture spatial audio.

3. The method as claimed in claim 2, comprising obtaining a plurality of audio signals from the plurality of microphones.

4. The method as claimed in claim 1, wherein the first audio signal and the local audio signals are made available for processing by being stored in a memory.

5. The method as claimed in claim 1, wherein the determined delay between the audio signals comprises a temporal delay between the obtained audio signals and jitter in transmission of the obtained audio signals.

6. The method as claimed in claim 1, comprising receiving one or more other audio signals wherein the one or more other audio signals are captured with one or more other microphone arrangements located at one or more locations different to the local microphone, and determining a temporal delay between the local audio signal and the one or more other audio signals, and using the determined temporal delay to determine a length of the one or more other audio signals to be made available for processing so as to enable temporal alignment of the local audio signal and the one or more other audio signals.

7. The method as claimed in claim 1, wherein the temporal alignment of the obtained audio signals enables an immersive audio output to be rendered to one or more users.

8. The method as claimed in claim 7, wherein the one or more users are located at different locations.

9. The method as claimed in claim 1, wherein the determined delay between the obtained audio signals is determined with respect to a reference point.

10. The method as claimed in claim 1, comprising sending a signal comprising information indicative of the length of the first audio signal and the local audio signal to be made available for processing to a processing device.

11. An apparatus comprising:

processing circuitry; and memory circuitry including computer program code, the memory circuitry and the computer program code configured to, with the processing circuitry, enable the apparatus to:

obtain a first audio signal from at least a first microphone located at a first distance from an audio source;

obtain a local audio signal from a local microphone wherein the local microphone is located closer to the audio source than the first microphone;

identify the audio source using the first audio signal and the local audio signal;

use the identified audio source to determine a delay between the first audio signal and the local audio signal; and use:

the determined delay, and at least one parameter, related to a bitrate associated with the identified audio source, to determine a length of the first audio signal and the local audio signal to be made available for processing, wherein the determined length is configured to enable temporal alignment of at least the first audio signal and the local audio signal.

12. The apparatus as claimed in claim 11, wherein the first microphone is part of a microphone array comprising a plurality of microphones arranged to capture spatial audio.

13. The apparatus as claimed in claim 12, wherein the processing circuitry and the memory circuitry are arranged to obtain a plurality of audio signals from the plurality of microphones.

14. The apparatus as claimed in claim 11, wherein the first audio signal and the local audio signals are made available for processing by being stored in a memory.

15. The apparatus as claimed in claim 11, wherein the determined delay between the audio signals comprises a temporal delay between the obtained audio signals and jitter in transmission of the obtained audio signals.

16. The apparatus as claimed in claim 11, wherein the processing circuitry and the memory circuitry are arranged to receive one or more other audio signals wherein the one or more other audio signals are captured with one or more other microphone arrangements located at one or more locations different to the local microphone, and determine a temporal delay between the local audio signal and the one or more other audio signals, and using the determined temporal delay to determine a length of the one or more other audio signals to be made available for processing so as to enable temporal alignment of the local audio signal and the one or more other audio signals.

17. The apparatus as claimed in claim 11, wherein the temporal alignment of the obtained audio signals enables an immersive audio output to be rendered to one or more users.

18. The apparatus as claimed in claim 17, wherein the one or more users are located at different locations.

19. The apparatus as claimed in claim 11, wherein the determined delay between the obtained audio signals is determined with respect to a reference point.

20. The apparatus as claimed in claim 11, wherein the processing circuitry and the memory circuitry are arranged to send a signal comprising information indicative of the length of the first audio signal and the local audio signal to be made available for processing to a processing device.

* * * * *